United States Patent [19]

Chammas et al.

[11] 4,158,389

[45] Jun. 19, 1979

[54] CHEMICAL CUTTING APPARATUS AND METHOD FOR USE IN WELLS

[75] Inventors: Edmond D. Chammas; Edwin C. Lewis, II, both of Houston, Tex.

[73] Assignee: Weatherford/DMC, Inc., Houston, Tex.

[21] Appl. No.: 885,062

[22] Filed: Mar. 9, 1978

Related U.S. Application Data

[62] Division of Ser. No. 830,511, Sep. 6, 1977, Pat. No. 4,125,161.

[30] Foreign Application Priority Data

Apr. 18, 1977 [GB] United Kingdom ..... 16064/77

[51] Int. Cl.[2] ..... E21B 29/00

[52] U.S. Cl. ..... 166/297; 166/55; 166/212

[58] Field of Search ..... 166/55, 55.1, 55.2, 166/63, 212, 120, 297, 298, 299, 169, 217

[56] References Cited

U.S. PATENT DOCUMENTS

| | | | |
|---|---|---|---|
| 2,629,445 | 2/1953 | Dill | 166/55 X |
| 2,701,614 | 2/1955 | Ragan et al. | 166/120 X |
| 2,918,125 | 12/1959 | Sweetman | 166/55 X |
| 3,076,507 | 2/1963 | Sweetman | 166/55.2 X |
| 3,450,203 | 6/1969 | Patron et al. | 166/55.1 |

*Primary Examiner*—Stephen J. Novosad
*Attorney, Agent, or Firm*—Fulbright & Jaworski

[57] ABSTRACT

A chemical cutting apparatus and method for cutting objects in well bores such as, for example, tubing in the bore of an oil or gas well. The apparatus is properly positioned relative to the object to be cut by means of a casing collar locator and an igniter is fired, which in turn activates a gas generator. Pressure from the gas generator axially displaces a slidable piston having one or more wedges pivotally connected thereto. Movement of the piston both pivots and extends the wedge, thereby bringing the wedge into contact with the object to be cut and anchoring the apparatus relative to the object to be cut. The pressure generated in the gas generator is communicated through a passageway in the slidable piston and forces a chemical cutting agent into a chamber containing a reactant. The reaction of the chemical cutting agent and reactant increases the pressure and temperature within the chamber thereby displacing along the axis a second slidable piston. Movement of the second slidable piston exposes radial exhaust orifices thereby allowing the reacting elements in the chamber to escape with great velocity and to contact the object to be cut.

11 Claims, 6 Drawing Figures

12
10
14
62
15
17
16
18

17
20
18
22
21
23
24
25
28
4
4
26
20
30
29
32
36

30
24
23
24
22
20

CHEMICAL CUTTING APPARATUS AND METHOD FOR USE IN WELLS

CROSS REFERENCES

This is a division of application Ser. No. 830,511 filed Sept. 6, 1977, now U.S. Pat. No. 4,125,161.

BACKGROUND OF THE INVENTION

It is frequently necessary or desirable in oil field operations to cut, for example, tubing in the bore of an oil or gas well. Because of the depth often involved, it is mandatory that the cut be successful on one attempt, otherwise unnecessary time and expense result in raising the first cutting device and lowering a second device.

Any downhole cutting device must employ means to anchor the device relative to the object to be cut, such that the chemical elements reacting with each other and exhausting onto the tubing be confined for a sufficient time to a precise area in order to insure a successful cut. Furthermore, because high well head pressures are often encountered during downhole cutting operations, it is both necessary and desirable to generate within the cutting apparatus sufficient temperatures and pressures to overcome the wellhead pressure while at the same time developing a sufficient overpressure to attack and cut the tubing.

STATEMENT OF THE PRIOR ART

As regards the most relevant prior art of which Applicant is aware, a chemical cutting device that has been known and used in oil field operations is disclosed in U.S. Pat. No. 2,918,125 (hereinafter referred to as the "'125 patent"). A more recent device is disclosed in U.S. Pat. No. 3,076,507 (hereinafter referred to as the "'507 patent"). It will be noted that the '507 patent is similar to the '125 patent except that a chemical pre-cleaner is disposed within and utilized by the '507 device.

It is oftentimes necessary to cut the tubing or other similar object in a well bore under conditions of high hydrostatic pressure conditions. Consequently, any chemical cutting device must be able to generate sufficient internal pressure for a sufficient length of time such that the cutting chemical is exhausted under sufficient pressure and length of time to insure a clean cut of the object. The device disclosed in the '125 patent is somewhat less than satisfactory for operations involving high hydrostatic wellhead pressures, whereas, the present invention, being fully operable under such conditions, owing to a secondary piston, is a significant improvement over the prior art. In addition, the anchor means of the present invention constitutes an important improvement over the prior art.

SUMMARY OF THE INVENTION

The present invention relates to a chemical cutting apparatus and method wherein the apparatus is a housing composed of a series of interlocking sub assemblies (hereinafter referred to as "subs"). The diameters of the various subs are necessarily dependent upon the diameter of the object to be cut. Orienting the device to the vertical position, the most common orientation for use in a wellhole, a casing collar locator, suitable for locating the chemical cutting apparatus relative to the desired point to be cut, is disposed on top. Attached to the bottom of the casing collar locator is a firing sub containing the ignition means. Below the firing sub is a gas generator sub containing a standard granular gas generating material which is activated by an igniter in the firing sub. Below the gas generator sub is an anchor sub with means for substantially centering and preventing movement of the device relative to the object to be cut during the period of cutting. Attached to the bottom of the anchor sub is a chemical cylinder containing a chemical cutting agent. A catalyst sub, containing a reactant material, is attached to the bottom of the chemical cylinder. A severing head having exhaust orifices is affixed to the bottom of the catalyst sub and communicates therewith. Within the severing head is an axially aligned and slidable piston resting on a shearable washer, the piston having sealing means to interrupt communication through the interior of the severing head. Pressure of the chemical cutting fluid forces the slidable piston downward while shearing the shear washer, thereby opening the exhaust orifices and allowing the cutting fluid and reactant under high pressure and temperature to exhaust through the exhaust orifices and onto an object to be cut.

It is therefore an object of the present invention to provide a device which is fully capable of generating a high pressure and temperature capable of cleanly cutting an object in an earth bore, such as, for example, metal tubing.

Another object of the present invention is to provide means whereby the high pressure, high temperature reaction of the chemical cutting agent and reactant is not released onto the tubing until the pressure thereof exceeds at least a summation of the wellhead pressure and the shear strength of the washer.

It is yet another object of the present invention to provide means on the device for substantially centering the chemical cutting apparatus within the tubing while at the same time substantially preventing movement along the axis of the tubing as the chemical cutting agent and reactant are being exhausted from the cutting device.

A still further object of the present invention is to enclose the chemical cutting agent between two rupture discs thereby minimizing premature firing of the tool and increasing the safe use thereof.

An even further object of the present invention is to dispose a slidable piston axially within the firing head and adjacent to the exhaust orifices such that the wellhead pressure can be communicated through said exhaust orifices, along the cylindrical walls of the sildable piston and therefore exerted on the bottom end wall of said piston, thereby insuring that the ignited cutting agent and reactant cannot exhaust through the orifices until the shear strength of the washer as well as the wellhead pressure on the bottom of the piston are exceeded by the pressure generated by the cutting agent and reactant.

Other and further objects, features and advantages will be apparent in the following description of a preferred embodiment of the invention, given for the purpose of disclosure and taken in conjunction with the accompanying drawings.

DESCRIPTION OF THE PREFERRED EMBODIMENTS

Figure 1A:
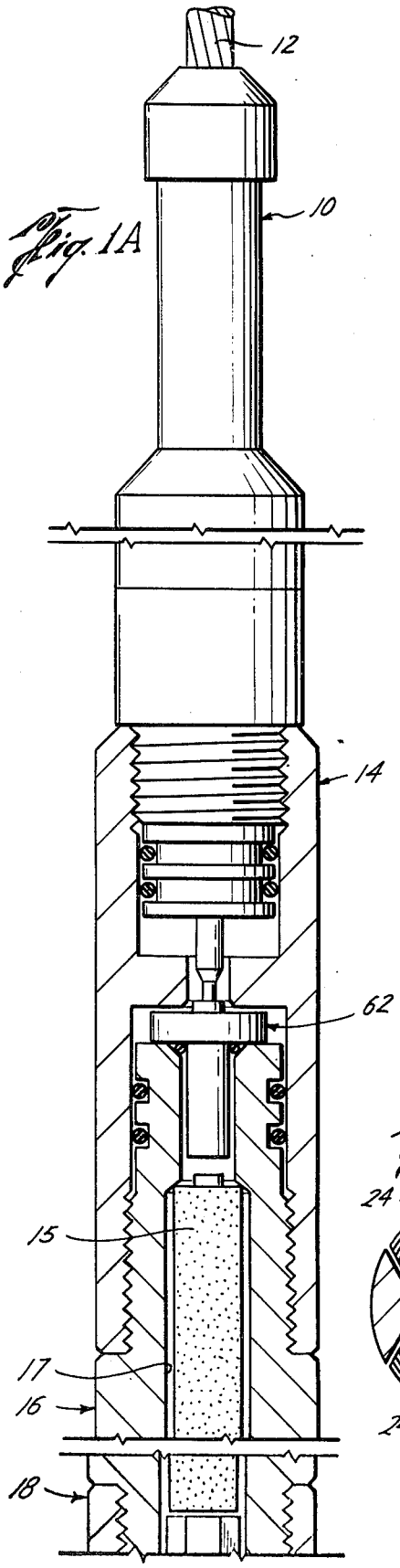
FIG. 1A is a foreshortened elevational view in section showing the casing collar locator, the firing sub housing a standard igniter and a gas generator sub containing a gas generator material therein.

Referring now to FIG. 1A, the uppermost part of the tool of the present invention includes a "CCL" cable head assembly 10 and a wireline 12, "CCL" meaning a conventional casing collar locator. Connected to the CCL is the firing sub adaptor 14 which in turn connects to the gas generator sub 16. The function of the gas generator sub 16 is to hold the gas generator grain 15 or propellant that will develop gas pressure required for activating the tool. The gas generator grain 15 may be any suitable slow-burning propellant such as a "pressurizing medium" as in the '125 patent. The propellant generates gases when properly initiated with an initiator or an igniter in the igniter sub 14, the latter being any suitable conventional igniter means. The preferred propellant is an ammonium nitrate base with a hydrocarbon binder, designated commercially as "RDS-254."

Figure 1B:
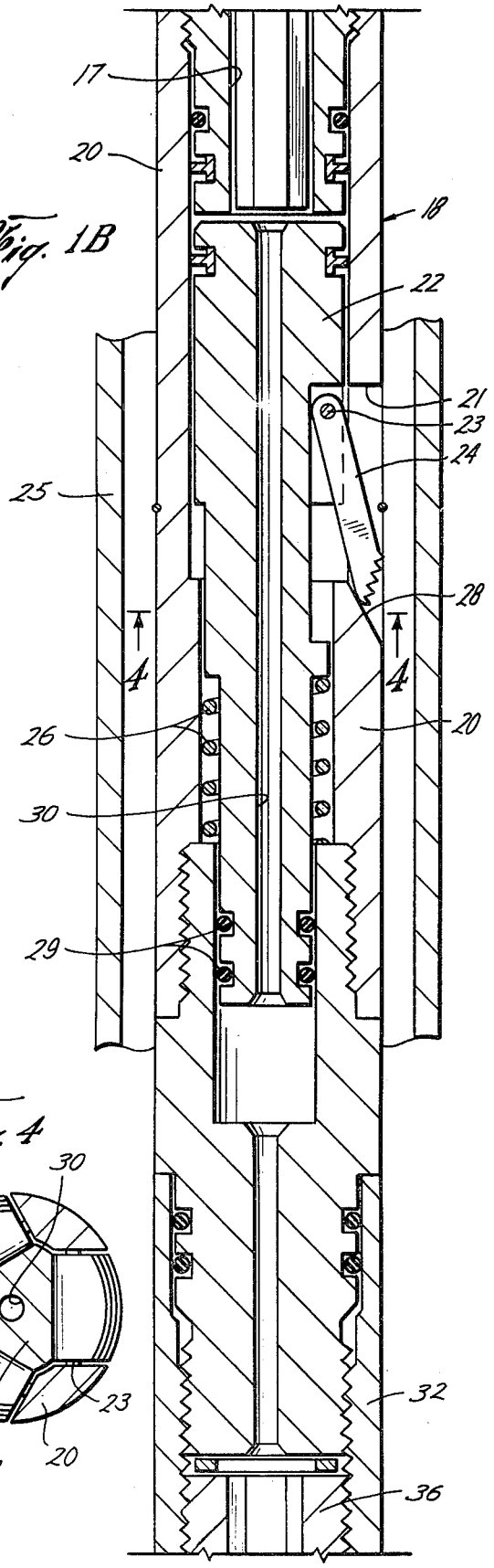
FIG. 1B is an elevational view in section showing the anchor sub with a slidable piston therein having an axial bore running therethrough, at least one pivotally extendible wedge journalled to the slidable piston and a spring to bias the slidable piston upward as shown on the drawing.
Figure 4:
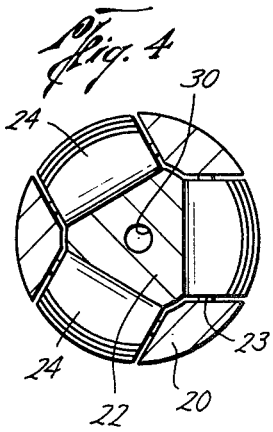
FIG. 4 is a partial cross-sectional view taken along lines 4—4 of FIG. 1B illustrating the piston-wedge combination wherein the wedges are shown in a collapsed position.
Figure 2:
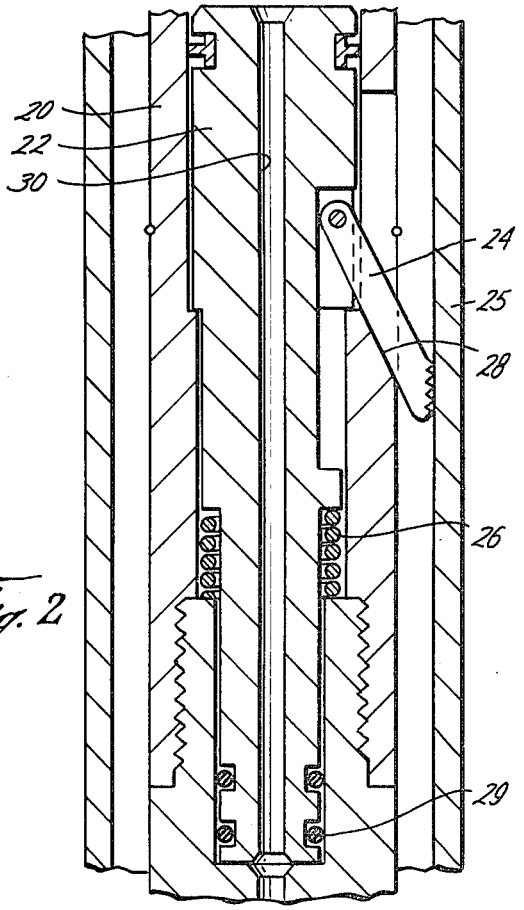

As shown in FIG. 1B, attached to the gas generator sub 16 is the anchor sub 18 that includes the anchor sub body 20 and the anchor sub piston assembly 22. The anchor sub piston assembly 22 has three pivotally attached wedges 24, each journalled to the body 20 by means of a pin 23 and positioned at 120° radial phasing (as shown in FIG. 4, which illustrates the wedges in a collapsed position as compared with FIG. 1B), and the piston 22 is biased upwardly by a spring 26. The spring 26 should be constructed of suitable material so as to withstand the pressure exerted on it as well as the heat that is generated and the corrosive by-products from operation of the tool. When pressure is generated by the burning of the propellant grain in the gas generator sub 16, it forces the piston 22 to move downwardly in the body 20 as shown in FIG. 2, thereby forcing each of the wedges 24 through an elongate aperture 21 in the body 20 and on a tapered surface 28 to move out of the body 20 and engage the pipe or tubing 25 to be cut so that the tool will be anchored positively within the pipe 25 to be cut and centralize at the same time. Since the wedges 24 are in the same plane, they will extend outwardly simultaneously therefore assuring the proper positioning of the tool in the tubing 25 prior to the activation of the chemical as will be explained.

Preferably the tapered surface 28 in each of the windows 21 of the body 20 is at about a 30° angle relative to the axis of the tool. This angle may vary from about 28° to 33°, providing good support for the wedges 24 prior to firing.

The length of each wedge 24 is important inasmuch as the wedge must move outwardly sufficiently so that it will attach to and hold the interior diameter surface of the tubing 25 that is to be cut. For example, a tool having an outer diamater of 1-11/16 inches (i.e., the body 20) is set in tubing that is 1.995 inches interior diameter to cut the tubing 25. Thus each of the wedges 24 must extend to a point comprising an outer diameter slightly greater than 2 inches. In this particular example, the wedges could extend to a maximum of 2.1 inches to allow for drift diameter of the tubing 25, and the outer end of each of the wedges 24 is located approximately 0.0015 inch inwardly from the outer diameter of the anchor sub body 20 in the prefiring position as shown in FIG. 2. The wedges 24 thus in effect expand the effective diameter of the body 20 in three places. This can be accomplished also with two wedges, with four wedges, or five or with as many as the anchor sub body 20 of the tool can accommodate, each wedge being wide enough to have holding surface area bearing against the tubing to be cut without weakening the body 20. Also, it is not necessary that all of the wedges be in the same axial plane. In a larger diameter tool, three wedges may be radially spaced at 120° at one vertical level and three more at another vertical level, for example. Finally, at the lower extremity of the piston there are grooves to accommodate seals 29.

There is shown in FIG. 1B an axial bore 30 through the piston 22. This bore allows gas pressure that is generated in the gas generator 16 to be transmitted into the lower section of the tool for coaction with chemical 31 in the chemical cylinder 32 (FIG. 1C), the chemical being expelled from the orifices of the severing head to effect the cut in the tube. However, the bore 30 of the piston 22 is of a smaller diameter than the bore 17 of the gas generator sub 16 so as to create a restriction to force the piston 22 downwardly upon firing of the tool.

Figure 1C:
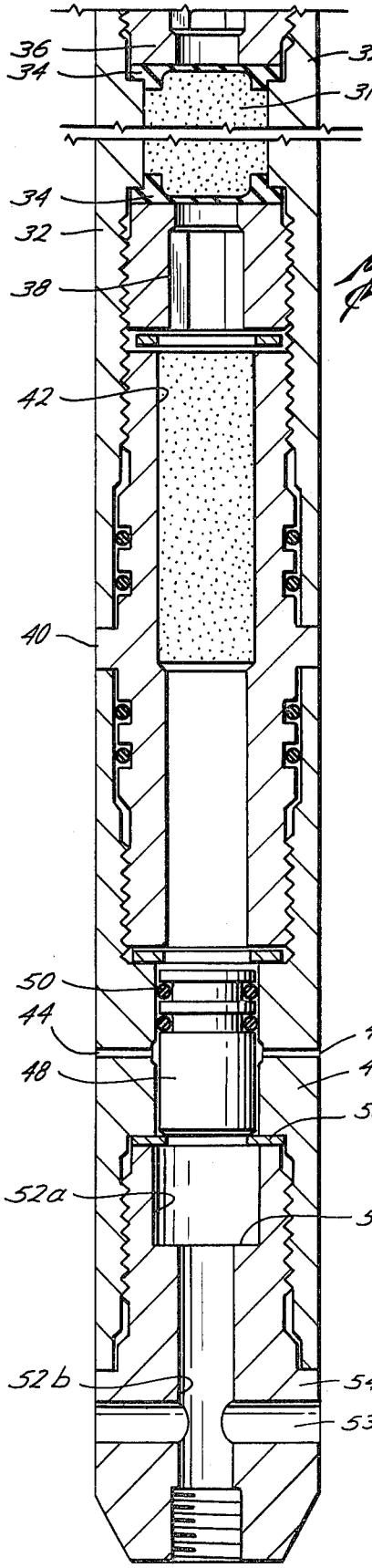
FIG. 1C is an elevational view in section and foreshortened for clarity showing the chemical cylinder housing a chemical cutting agent or fluid disposed between two rupture discs, a catalyst sub housing a chamber therein and communicating with the severing head sub.

Referring now to FIG. 1C, attached to the anchor sub 18 is the chemical cylinder 32 which contains a cutting fluid 31. Any of the cutting fluids that are disclosed in the '125 patent may be used, brominetrifluoride being preferred. The chemical cylinder 32 must have a certain length and bore diameter so as to contain a volume of chemical in proportion to the size of tubing that is being cut. Because the cutting process involves an oxidation-reduction reaction, the amount of chemical needed is in proportion to the amount of metal in the tubing that is being cut. A larger tubing would require more chemical than a smaller tubing and therefore the size of tubing being cut dictates the size of the cylinder 32.

A safety feature embodied in the tool of the present invention is the use of rupture discs 34 in the upper and lower ends of the bore of the cylinder 32. The upper rupture disc is positioned below a jam insert 36 while the lower rupture disc is above a jam insert 38. Thus the rupture discs 34 seal the chemical 31 within the bore of the cylinder 32. The rupture discs serve to rupture at a predetermined pressure which is important in the functioning of the tool from a safety standpoint. A preset rupture strength, preferably about 8500 pounds per square inch (psi) is selected to avoid premature firing of the tool in the well should any fluid from the well leak into the tool. The rupture discs maintain back pressure on the orifices in the severing head to develop pressure should cutting take place in a shallow well having less than 8500 pound pressure hydrostatic head. While the preferred burst pressure is 8500 psi, the tool could function at lower pressures, the 8500 psi rupturing pressure being selected to eliminate premature firing of the tool in most applications. Both ends of the cylinder 32 are identical as are the two jam nuts 36 and 38 and the two rupture discs 34. The discs may rupture from one end or the other end internally or externally at the same pressure.

Referring again to FIG. 1C, threaded member 40 comprising a catalyst sub is threadedly attached to the chemical cylinder 32. While the material placed within the bore 42 of the sub 40 is not necessarily a catalyst per se, it is material that will react with the chemical 31 to produce the necessary temperature to start the fast oxidation process between the chemical 31 and the tubing to be cut. It is yet indeterminable whether the interaction of the chemical cutting agent 31 and the matter in the bore 42 of the sub 40 is catalytic or reactive; the result, however, is that ignition does occur which greatly increases the velocity and effectiveness of the cutting action of the ignited chemical cutting agent. The material in the bore 40 of the catalyst sub 40 can be of any of the preignition materials disclosed in the '125 patent such as glass wool, steel wool and the like. As an alternative if desired, the preignition material rather than being contained in the sub 40 can be placed circumferentially around and adjacent to the orifices 44 in the severing head 46 (described below). Of course, modification of the severing head 46 to accommodate the preignition material would be necessary.

Advantageously, the by-product of the gas generator 16 reacts with the chemical 31 contained in the chemical cylinder 32 to produce additional energy, temperature, and pressure that are useful in the completion of the reaction between the chemical 31 and the tubing to be cut. The by-products include hydrocarbon materials that react violently with the chemical 31, thereby increasing the temperature of the reaction of the chemical 31 with the pipe or tubing 25 to be cut.

The evolution of gas in the gas generator 16 exerts pressure on the upper rupture disc 34, rupturing the disc and forcing the chemical 31 downward and then rupturing the bottom rupture disc 34 such that the chemical 31 passes over the reactant or igniter material in the bore 42, igniting that material. Thus, the first ignition takes place in the catalyst sub 40. The hot molten particles or globules that are contained in this catalyst are forced out through a plurality of radial orifices 44 in the severing head 46 and attack the interior diameter of the tubing 25 so that hot particles heat the surface of the tubing 25 preparing it for a further reaction between the chemical 31 and the surface of the tubing 25.

Figure 3:
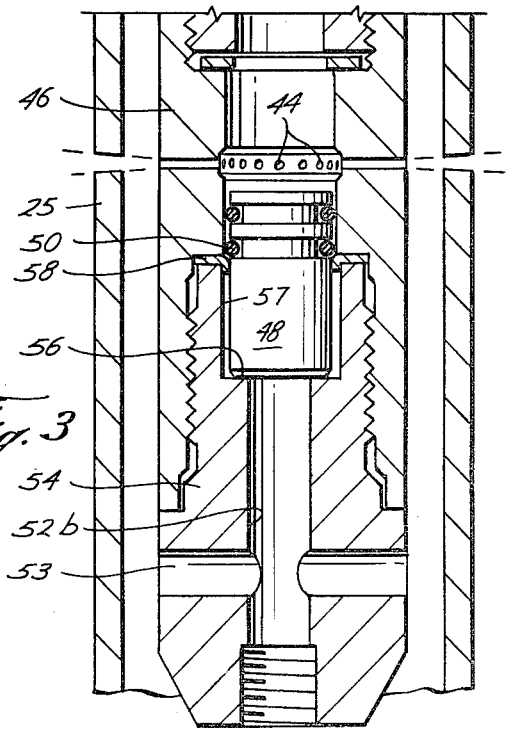

The severing head 46 is a cylindrical member. The severing head carries orifices 44 which are located peripherally and radially around the outer diameter of the head. Through these orifices the chemical 31 and the reactant or catalyst are forced to attack the tubing as shown in FIG. 3. The material of construction of the severing head 46 preferably is a copper alloy so that heat is transmitted readily and the head itself does not enter into a reaction or burn with the chemical 31. The size and number and hence the total area of the orifices 44 should be in direct proportion to the area of the bore 30 in the anchor sub piston 22. Construction of the severing head 46 can be varied from that shown in the drawings. Instead of the provision of a plurality of radial orifices 44, a circumferential separation, slot or gap in place of the orifices and of a predetermined surface area, i.e. equal to or preferably smaller than that of the cross-sectional area of the bore 30 in the anchor sub piston 22, would achieve the desired end result of severing the pipe 25.

Within the severing head 46 is a secondary piston 48 having at least one "O" ring seal 50 that prevents fluid from the well from entering into the catalyst sub 40. There are no "O" rings in the lower half of the piston 48 so that well fluid may enter through the orifices 44 and circulate out through the bore **52*a* and 52*b* of the bull plug 54 which is the lowermost section of the tool. Also provided for circulation are apertures 53 in the wall of the bull plug. Consequently, the hydrostatic head of the well exerts pressure on the piston 48 retaining the piston 48 in the position shown until sufficient pressure is generated equal to or greater than the hydrostatic head in the well. Should pressure in the well be, for example, 20,000 psi, the piston 48 will not move from the position shown in FIG. 1C into its receptacle in the bull plug as shown in FIG. 3 until the gas generator 16 has developed sufficient pressure in excess of 20,000 psi so that the piston 48 moves downwardly to shear the washer 58 and then engage the shoulder 56 in the bore of bull plug 54, allowing the chemical 31 that has passed over the reactant or catalyst out of the orifices 44 at a greater pressure than the back pressure of the well fluid surrounding the orifices. Prior to this, the piston 48 rests on the shear washer 58** such as a copper washer or other suitable means serving as a shear mechanism.

The bottom portion of the bore 52 of the bull plug 54 is threaded as a convenience for the operator of the tool to attach a conventional mechanical centralizing system to insure centralizing of the severing head 46 inside of the tubing to be cut should there be a bend in the tubing.

Assembly of the tool of the present invention begins by degreasing and cleaning all of the component parts by use of a solvent that will leave no residue on the parts. After the parts have been washed with the degreasing fluid, they are blown dry with air. All "O" ring grooves receive the proper "O" ring and "T" seals and backup rings when required. The gas generator sub 16 receives the gas generator grain in the bore 17. The anchor sub piston is asembled by attachment of the wedges 24, the spring 26, "O" rings and "T" seals to the piston 22 which is then inserted in the body 20. The wedges 24 are positioned on the taper 28 in a prefiring position. Then the anchor sub assembly 18 is connected to the gas generator sub 16. The gas generator sub 16 applies sufficient force on the piston 22 to seat the piston in the proper position as shown in FIG. 1B.

When the lower sub-assembly of the tool, i.e. the catalyst sub 40, severing head 46 and the bull plug 54, is being assembled, a high temperature and viscous grease, such as water pump grease, is pumped into the bull plug through its bore 52 until it is circulated through the severing head orifices 44 (or gap) to prevent any solid particles, such as barite, sand, paraffin, or lost well circulation material, from blocking the orifices or packing the bull plug cavity. This procedure is used whenever it is suspected that any of a combination of the above mentioned materials are present in the well bore. Any solid compaction of the piston cavity or bore 57 in the bull plug would prevent the piston 48 from moving down and would cause the tool to fail to sever the pipe 25. The water pump grease (lubricant) serves two purposes. It keeps the solid particles from compacting the lower assembly as dispensed above, and the back pressure of well fluids is still maintained on the piston 48 as it is important to develop an internal pressure within the bore of the tool above the piston 48 greater than that of the well bore before the piston 48 moves down. Also the grease (lubricant) is not displaced by the suspended particles, and at the same time it is forced out of the bull plug by the piston.

Prior to the attachment of the chemical cylinder 32 to the rest of the tool, the cylinder is inspected for leakage that may have developed in transport. Preferably, the cylinder will be shipped to the field with the chemical 31 already in it and properly sealed with the jam inserts 36 and 38 and the rupture discs 34. Then the chemical cylinder 32 is attached to the anchor sub, followed by the catalyst sub 40, the severing head 46 and the bull plug 54. The tool is now completely made up with the exception of the firing adapter sub 14 and the igniter 62 (both conventional) that are placed in the upper portion of the gas generator. At this point the service unit operator insures that an electrical circuit connects through the casing collar locator 10, making certain that there are proper connections and an adequate supply of current coming through electrical lines.

In operation, once the point of the tubing 25 to be cut has been located, the operator lowers the tool to that point, sends a current through the wireline 12 that activates the igniter means 62 which in turn initiates the gas generator grain in the bore 17 of the sub 16 to generate pressure that is needed to force the piston 22 in the anchor sub 18 to set the wedges 24 in the tubing and anchor the tool positively in one place. The pressure wave continues through the bore 30 of the anchor sub piston 22 to rupture the discs 34 in the chemical cylinder 32, forcing the chemical 31 to pass over the catalyst or reactant in the bore 42 of catalyst sub 40 and out through the orifices 44 in the severing head where the reaction takes place cutting the pipe after moving the piston 48 downwardly to shear the shear washer 58.

Advantageously, the system of the present invention functions to take advantage of the added energy developed by the reaction of the grain byproduct (from the gas generator 16) and the chemical 31 to generate greater pressures inside of the tool so that the tool can operate at greater depths and under greater hydrostatic heads than prior art tools thereby allowing the chemical 31 to be expelled through the orifices 44 in the severing head 46 for purposes of attacking the pipe 25 and making the cut. Pressures inside of the tool have been obtained in excess of 33,000 lbs. per square inch owing to the arrangement of parts described herein. The system of the present invention can build any amount of pressure internally to overcome the hydrostatic head in the well and maintain a pressure differential of at least 2000 to 3000 psi above the well pressures so that the chemical 31 can be expelled through the orifices 44 and not be forced to remain inside of the tool and react inside of the tool as is sometimes the case in the tool of the '125 patent. The tool of the '125 patent experiences operational difficulties when it is exposed to higher pressures since the tool seldom develops the higher pressure needed and cannot maintain high pressure for any length of time to allow the chemical to be expelled through the orifices to react with the pipe.

As mentioned above, the preferred grain for use in the gas generator 16 of the present invention is available commercially under the designation "RDS-127" or "RDS-254." This grain is basically an ammonium nitrate base with a hydrocarbon binder. Thus its initiation and by-products provide hydrocarbon materials that react violently with the preferred chemical 31 which comprises brominetrifluoride. Consequently, high pressures (as compared with the prior art) are developed inside of the tool of the present invention, and the pressures are maintained albeit instantaneously until the reaction between the chemical 31 and the pipe or tubing 25 takes place.

The present invention, therefore, is well adapted to carry out the objects and attain the ends and advantages mentioned as well as others inherent therein. While a presently preferred embodiment of the invention has been given for the purpose of disclosure, numerous changes in the detail of construction and the combination, shape, size and arrangement of parts may be resorted to without departing from the spirit and scope of the invention as hereinafter claimed.

What is claimed is:

1. Apparatus for cutting an object within an earth bore, comprising a generally elongate, cylindrical structure that includes, (a) means for suspending the apparatus within the bore, (b) firing means for producing ignition temperatures, (c) means for generating gas by ignition from the firing means (b), (d) anchor means for maintaining the apparatus substantially stationary in axial relation to the earth bore during the cutting operation, including:

(i) a cylinder having at least one aperture in the cylindrical wall thereof, (ii) a piston slidable within the cylinder (i), (iii) at least one wedge member pivotally secured to the piston and engageable with the aperture of the cylinder (i), and (iv) means biasing the piston (ii) against the cylinder (i) such that the wedge member (iii) is yieldably retained within the aperture of said cylinder, (e) chemical means releasably contained within the apparatus for incendiary cutting of the object within the earth bore upon release of said chemical means, and (f) discharge means for directing the chemical means (e) toward the object to be cut within the earth bore.

2. The apparatus of claim 1 wherein the anchor means cylinder (d) (i) includes a tapered surface forming part of the aperture, the wedge member (d) (iii) slidably engaging said tapered surface.

3. The apparatus of claim 1 wherein the biasing means (d) (iv) comprises a compression spring.

4. Apparatus for cutting an object within an earth bore, comprising a generally elongate, cylindrical structure that includes, (a) means for suspending the apparatus within the bore, (b) firing means for producing ignition temperatures, (c) means for generating gas by ignition from the firing means (b), (d) anchor means for maintaining the apparatus substantially stationary in axial relation to the earth bore during the cutting operation, including, (i) a cylinder having at least one aperture in the cylindrical wall thereof, (ii) a piston slidable within the cylinder (i), (iii) at least one wedge member pivotally secured to the piston and engageable with the aperture of the cylinder (i), and (iv) means biasing the piston (ii) against the cylinder (i) such that the wedge member (iii) is yieldably retained within the aperture of said cylinder, (e) chemical means releasably contained within the apparatus for incendiary cutting of the object within the earth bore upon release of said chemical means, and (f) discharge means for directing the chemical means (e) toward the object to be cut within the earth bore, including:

(i) a body member forming a segment of the generally elongate cylindrical structure of the apparatus and having a bore therethrough, (ii) said body member (i) having at least one radial aperture providing communication between the bore of said body member and the exterior of the body member, (iii) a piston coaxial with and axially slidable within the bore of the body member (i) between a first position adjacent the radial aperture (ii) and a second position spaced from said radial aperture, (iv) means for releasably retaining the piston (iii) in its first position, and (v) seal means for preventing fluid communication between one end of the body member (a) and the radial aperture (ii) when the piston (iii) is in its first position but permitting said fluid communication when the piston (iii) is in its second position.

5. The apparatus of claim 4 wherein the anchor means cylinder (d) (i) includes a tapered surface forming part of the aperture of said cylinder (d) (i), the wedge member (d) (iii) slidably engaging said tapered surface.

6. The apparatus of claim 5 wherein the tapered surface forming a part of the aperture of the cylinder (d) (i) comprises a taper in the cylinder wall projecting downwardly and outwardly at an angle of from about 28° to about 33° relative to the axis of said cylinder.

7. The apparatus of claim 4 wherein the biasing means (d) (iv) comprises a compression spring.

8. The apparatus of claim 4 wherein the body member (f) (i) includes a plurality of radial apertures (f) (ii).

9. The apparatus of claim 4 wherein the means (f) (iv) for releasably retaining the piston (f) (iii) in its first position comprises a shearable member.

10. The apparatus of claim 4 wherein the wherein the seal means (f) (b) comprises an "O" ring within an annular recess formed circumferentially of the piston (f) (iii).

11. A method for cutting an object in an earth bore comprising the steps of:

(a) disposing a housing containing a chemical cutting agent, said housing having exhaust apertures communicating the interior of the housing to the exterior thereof, adjacent to the desired location of the object to be cut, (b) generating pressure by means of a gas generator initiated by an igniter, (c) affixing the housing substantially centrally within the earth bore by means of at least one wedge disposed within an aperture of the housing having one end of said wedge pivotally attached to an axially aligned piston slidably disposed within said housing, said piston having a bore disposed axially therethrough, whereby axial displacement of the slidable piston extends the other end of the wedge radially from the housing, (d) contacting a reactant disposed within the housing with the cutting agent, and (e) exhausting the cutting agent and reactant through the exhaust orifices in the housing and into the object to be cut.

* * * * *